US009404687B2

(12) United States Patent
Rauch

(10) Patent No.: US 9,404,687 B2
(45) **Date of Patent: *Aug. 2, 2016**

(54) MAGNETIC PUMP INSTALLATION

(71) Applicant: NOVELIS INC., Atlanta, GA (US)

(72) Inventor: Edwin L. Rauch, Fulton, NY (US)

(73) Assignee: Novelis Inc., Atlanta, GA (US)

( * ) Notice: Subject to any disclaimer, the term of this patent is extended or adjusted under 35 U.S.C. 154(b) by 151 days.

This patent is subject to a terminal disclaimer.

(21) Appl. No.: 14/202,090

(22) Filed: Mar. 10, 2014

(65) Prior Publication Data

US 2014/0252697 A1 Sep. 11, 2014

Related U.S. Application Data

(60) Provisional application No. 61/776,316, filed on Mar. 11, 2013.

(51) Int. Cl.
*F27D 27/00* (2010.01)
*C21C 1/06* (2006.01)

(52) U.S. Cl.
CPC ..... *F27D 27/005* (2013.01); *C21C 1/06* (2013.01)

(58) Field of Classification Search
CPC ..... C21C 1/06; F27D 27/00; F27D 27/005
See application file for complete search history.

(56) References Cited

U.S. PATENT DOCUMENTS

| | | | |
|---|---|---|---|
| 2,528,209 | A | 10/1950 | Bonsack et al. |
| 2,536,325 | A | 1/1951 | Tama |
| 2,707,718 | A | 5/1955 | Tama |
| 3,330,900 | A | 7/1967 | Taylor et al. |
| 3,824,414 | A | 7/1974 | Laithwaite et al. |
| 4,586,698 | A | 5/1986 | Carbonnel |
| 5,984,999 | A | 11/1999 | Areaux et al. |
| 6,216,765 | B1 | 4/2001 | Tseng et al. |
| 6,391,247 | B1 | 5/2002 | Heine et al. |
| 6,851,587 | B1 | 2/2005 | Tseng |
| 7,316,800 | B1 | 1/2008 | Dardik et al. |
| 7,497,988 | B2 | 3/2009 | Thut |

(Continued)

FOREIGN PATENT DOCUMENTS

| | | |
|---|---|---|
| EP | 2375206 | 10/2011 |
| JP | 2011012951 | 1/2011 |
| WO | 2014164413 A1 | 10/2014 |

OTHER PUBLICATIONS

International Patent Application No. PCT/US2014/022364, International Search Report and Written Opinion mailed Jul. 9, 2014, 12 pages.

(Continued)

*Primary Examiner* — Lois Zheng
(74) *Attorney, Agent, or Firm* — Kilpatrick Townsend & Stockton LLP

(57) ABSTRACT

A magnetic pump in a pump well in a molten metal furnace with a long, relatively thin side wall that wraps around a significant fraction of the circumference of the pump, which facilitates creation of an eddy current based flow field in the molten material with better magnetic coupling, thereby enhancing the effectiveness of the pump. Breach of the well wall will not result in spillage of metal outside the furnace, and the well can be monitored for any such breach or other change so that the pump can be lifted out of the well to protect it from contact with the molten metal in the event of such a breach, or other appropriate action can be taken.

18 Claims, 7 Drawing Sheets

(56) References Cited

U.S. PATENT DOCUMENTS

| | | | |
|---|---|---|---|
| 8,158,055 | B2 | 4/2012 | Takahashi |
| 8,267,669 | B2 | 9/2012 | Kagan |
| 8,347,949 | B2 | 1/2013 | Anderson et al. |
| 8,420,008 | B2 | 4/2013 | Rauch |
| 8,599,899 | B2 | 12/2013 | Koriyama et al. |
| 8,623,271 | B2 | 1/2014 | Guest |
| 2008/0106830 | A1 | 5/2008 | Richardson et al. |
| 2010/0244338 | A1 | 9/2010 | Takahashi |
| 2011/0248432 | A1 | 10/2011 | Takahashi |
| 2014/0252698 | A1 | 9/2014 | Rauch |

OTHER PUBLICATIONS

European Patent Application No. 14 718 213.3, Office Action mailed Oct. 30, 2015, 6 pages.

U.S. Appl. No. 14/202,123, Non-Final Office Action mailed Oct. 21, 2015, 10 pages.

MAGNETIC PUMP INSTALLATION

RELATED APPLICATION

This application claims the benefit of U.S. Provisional Patent Application Ser. No. 61/776,316 filed Mar. 11, 2013, the entire contents of which are incorporated by reference.

FIELD OF THE INVENTION

The present invention relates to pumps used to circulate material in non-ferrous molten metal furnaces and, more specifically, to the location and operation of electromagnetic or permanent magnet-based molten metal pumps.

BACKGROUND

It is desirable for a number of reasons to cause material to flow in non-ferrous molten metal furnaces. Magnetic pumps are sometimes used to induce eddy currents in the metal in order to induce such flow or agitation. Electromagnetic devices are used in some known pumps, and permanent magnets are used in other such pumps. Such pumps are typically attached to the outside of a side wall of a furnace, and the molten metal may be piped into and around the pump structure (as in published U.S. patent application publication numbers 2011/0248432 and 2010/0244338, which are both incorporated herein by reference). This means that molten metal is moved outside the furnace, elevating the likelihood of an uncontained leak from such pumps and associated structures. Moreover, some existing devices project magnetic flux through furnace external walls, which need to be thick for safety reasons.

Each of these approaches can be inefficient in agitating molten metal and create a significant risk of leakage of molten metal through the side wall of the furnace or within the structures outside the furnace and through which the metal flows. Such a leak or breach may result in significant risk of leakage outside the pump structure, not to mention the risk of damage to the pump structure.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention solves the problems described above, and provides other benefits by positioning a magnetic pump, which may be an electromagnetic or permanent magnet based pump, at the entrance to a side well of the furnace and in a pump well with a long, relatively thin side wall that wraps around a significant fraction of the circumference of the pump. The long, thin side wall of the pump well and significant wrap angle around the pump well facilitates creation of a strong eddy current based flow field in the molten material with better magnetic coupling, thereby enhancing the effectiveness of the pump. The risk of breach of the relatively thin pump well wall is acceptable because breach of the well wall and flow of molten metal into the well will not result in spillage of metal outside the furnace. Moreover, the well can be monitored for any such breach so that the pump can be lifted out of the well to protect it from contact with the molten metal in the event of such a breach.

DETAILED DESCRIPTION

Figure 1:
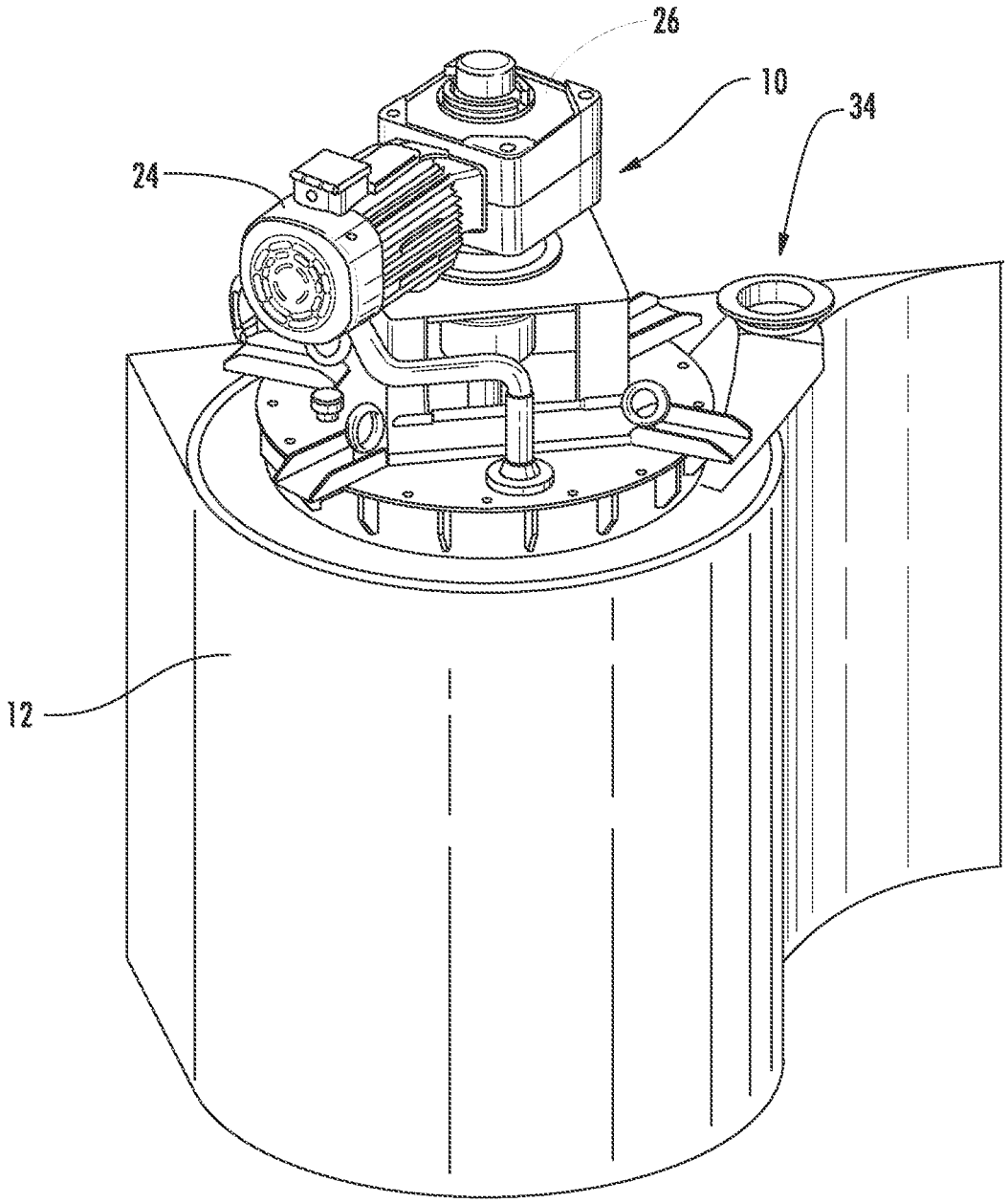
FIG. 1 is a perspective view of a pump of this invention in a well in a metal furnace.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The present invention solves the problems described above by positioning a magnetic pump 10, which may be an electromagnetic or permanent magnet based pump, in a well 12 located entirely inside the exterior wall 14 of a metal melting furnace 16 and near the entrance 22 to a side well 18 of furnace 16. Certain kinds of scrap may be added in the side well 18, and the extra turbulence in the molten metal generated by the pump 10 quickly submerges and melts the scrap. Agitation in side well 18 also agitates the metal in the main hearth area 20 of furnace 16.

Figure 2:
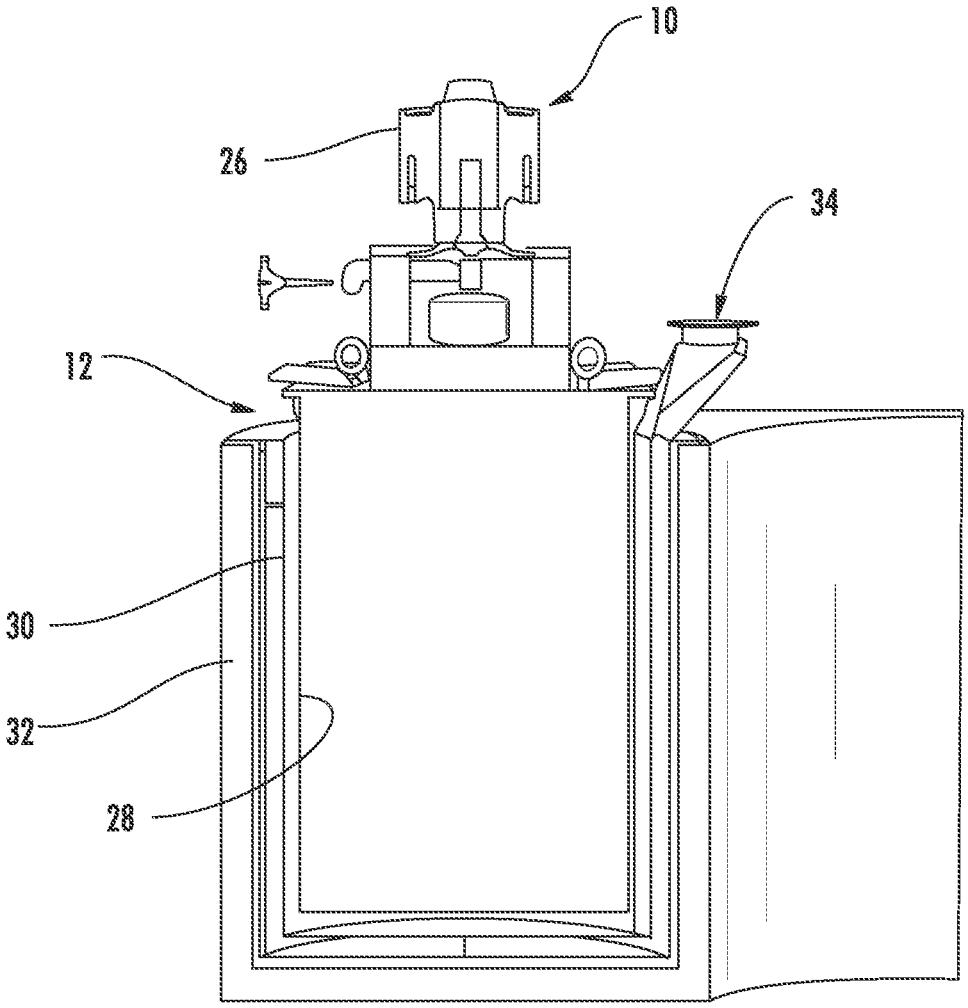
FIG. 2 is an elevation view, in section of the installed pump shown in FIG. 1.
Figure 3:
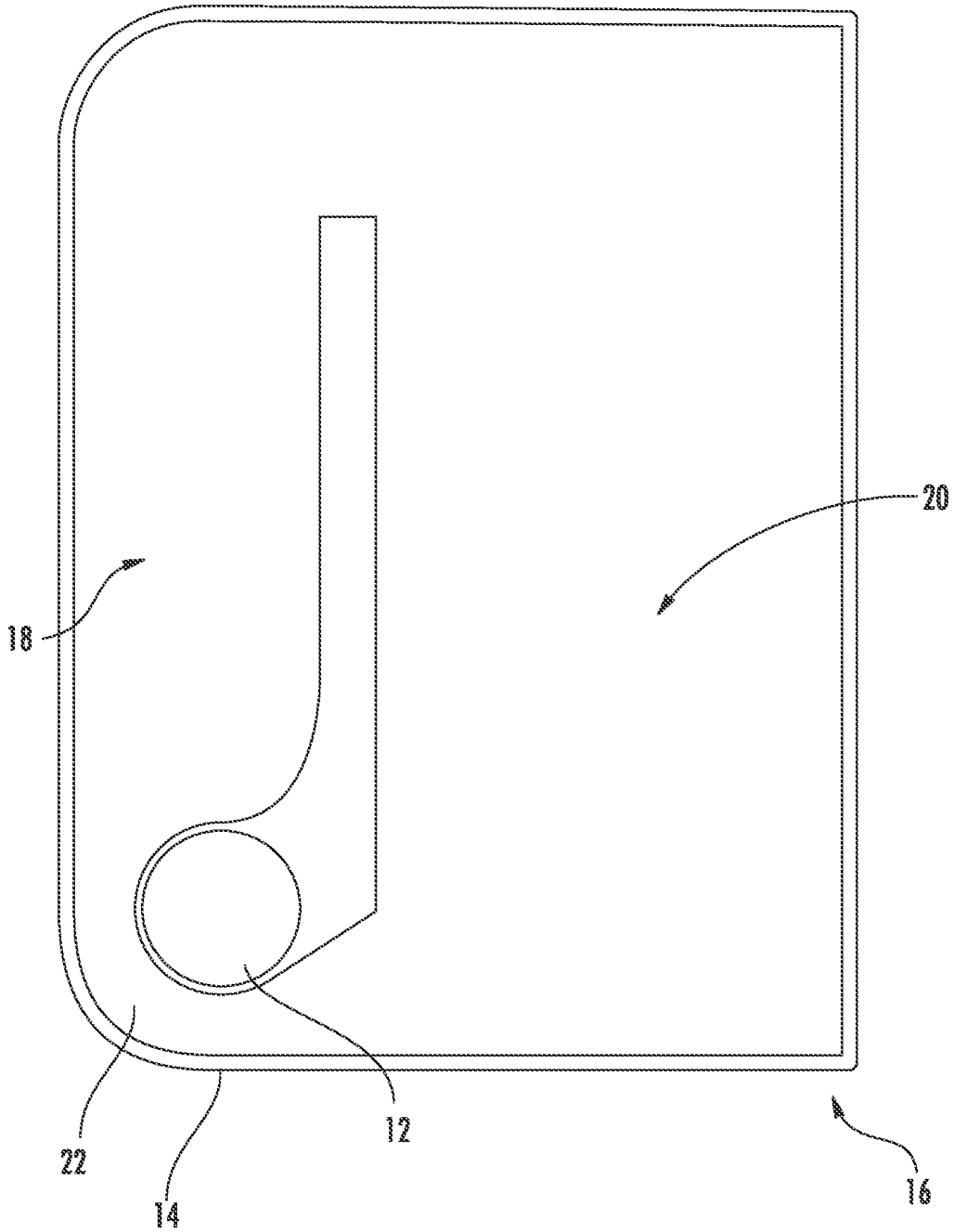
FIG. 3 is a schematic plan view of a furnace and pump of this invention.

While other pump configurations may be used, the pump 10 illustrated in FIGS. 1-2 is a permanent pump that is driven by a motor 24 coupled to a gear box 26. The motor 24 may be electrically powered with alternating current or direct current, hydraulically powered or otherwise operated to provide rotational force. The gear box 26, which may be interposed between the motor 24 and a vertical shaft (not visible in FIGS. 1-3), reduces the relatively high rotational speed of the motor 24. This provides a lower rotational speed for rotating an arrangement of one or more permanent magnets (also not visible in FIGS. 1-2) that rotate just inside the inner wall 28 of the cooling jacket 30 through which air, nitrogen or other suitable cooling medium is circulated through inlet 34.

Cooling jacket 30 is adjacent to a relatively thin refractory wall 32 of the furnace 16 well 12. This cooling maintains a thermal freeze plane. This reduces the likelihood that the aluminum or other molten metal will dissolve holes in the wall 32 of the well 12. If such holes nevertheless form, because the metal is still retained within the furnace, the consequences typically will be less severe than those potentially associated with breach of an exterior wall of a furnace.

Figure 8:
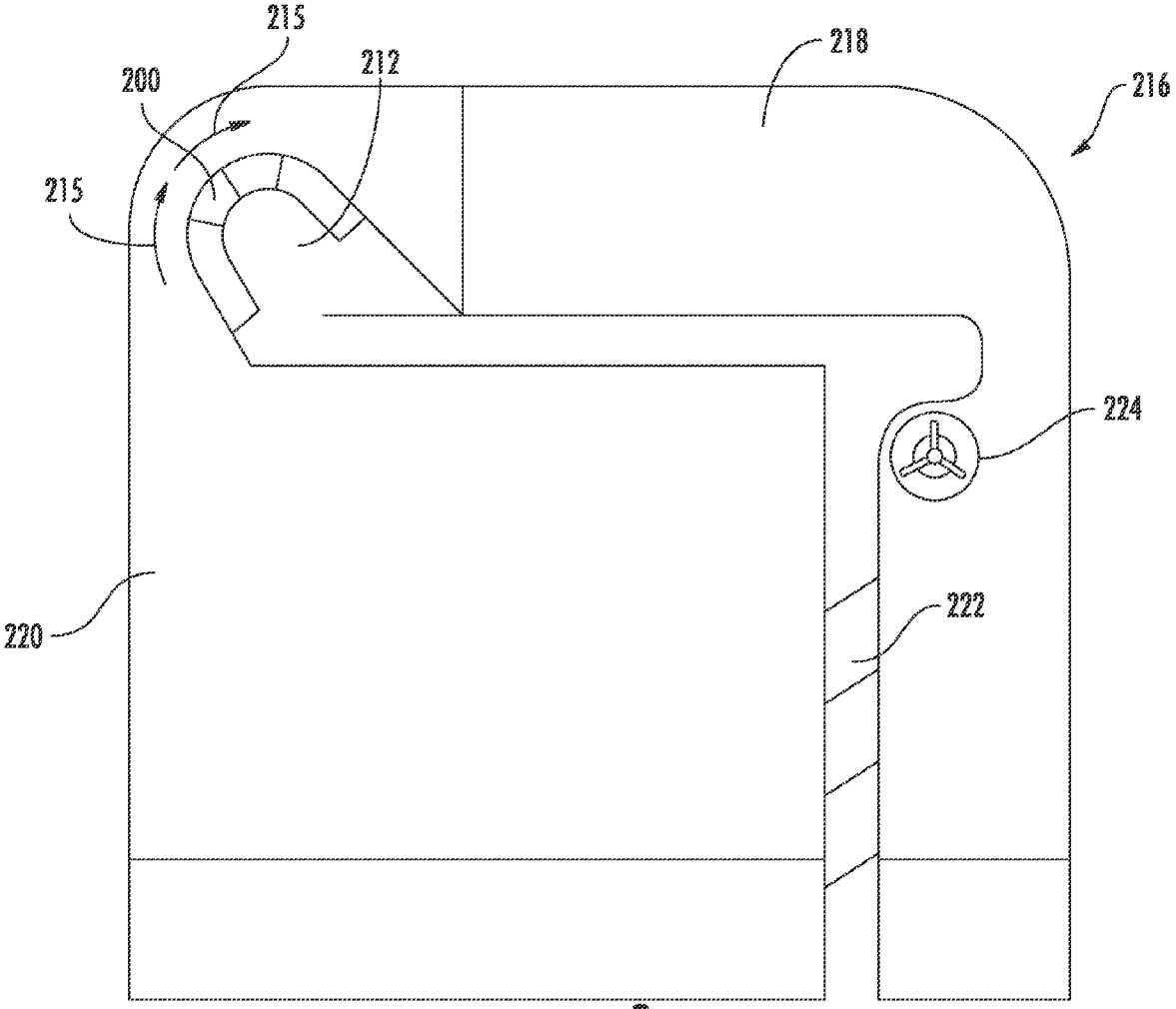
FIG. 8 is a schematic plan view of a furnace and pump according to another embodiment.

As mentioned, other pump arrangements, such as an electromagnetic pump, may be used instead of a permanent rotatable pump. For example, an induction motor such as the one described in U.S. Pat. No. 3,824,414, which issued Jul. 16, 1974 and is incorporated herein by reference, may be incorporated into a side well of a furnace. FIG. 8 illustrates a linear induction motor 200 that may be positioned in a well 212 located entirely inside a metal melting furnace 216 and near a side well 218 of furnace 116. In some embodiments, the surface that is normally flat in a linear induction motor is convex as illustrated in FIG. 8. Agitation in side well 212 also agitates the metal in other areas of the furnace and circulates the metal between the main hearth area 220 and the side well 218 of the furnace 216 in the direction of arrows 215. In some embodiments, submerged ports 222 allow metal to flow between side well 218 and hearth area 220. A submerging pump 224 may be used to submerge and melt any scrap (such as, without limitation, light gauge, clips, chips, or post-consumer based bale scrap) added to the side well 218.

The pump arrangement of this invention provides an open channel flow system to move molten metal due to the eddy current based flow field created by the magnetic pump, thereby agitating the metal and contributing to maintenance of homogeneous temperatures within the metal. The arrangement of the pump within a relatively thin wall of a well within the furnace minimizes the distance between the moving metal and the magnet, thus facilitating creation of strong eddy currents in the molten material, thereby enhancing the effectiveness of the pump.

In some cases, the magnetic pump is positioned within the furnace such that significant linear vortexes are created within the metal. For instance, the magnet may be positioned and configured to generate eddy current based flow field for the molten metal positioned within approximately half the thickness of the thin wall of the well (closest to the pump) and force a linear flow along this portion of the metal closest to the magnet. The other approximately half of the molten metal within the thin wall flows in a sympathetic, tortuous path that in turn generates a strong linear vortex throughout the depth of the well.

Figure 4:
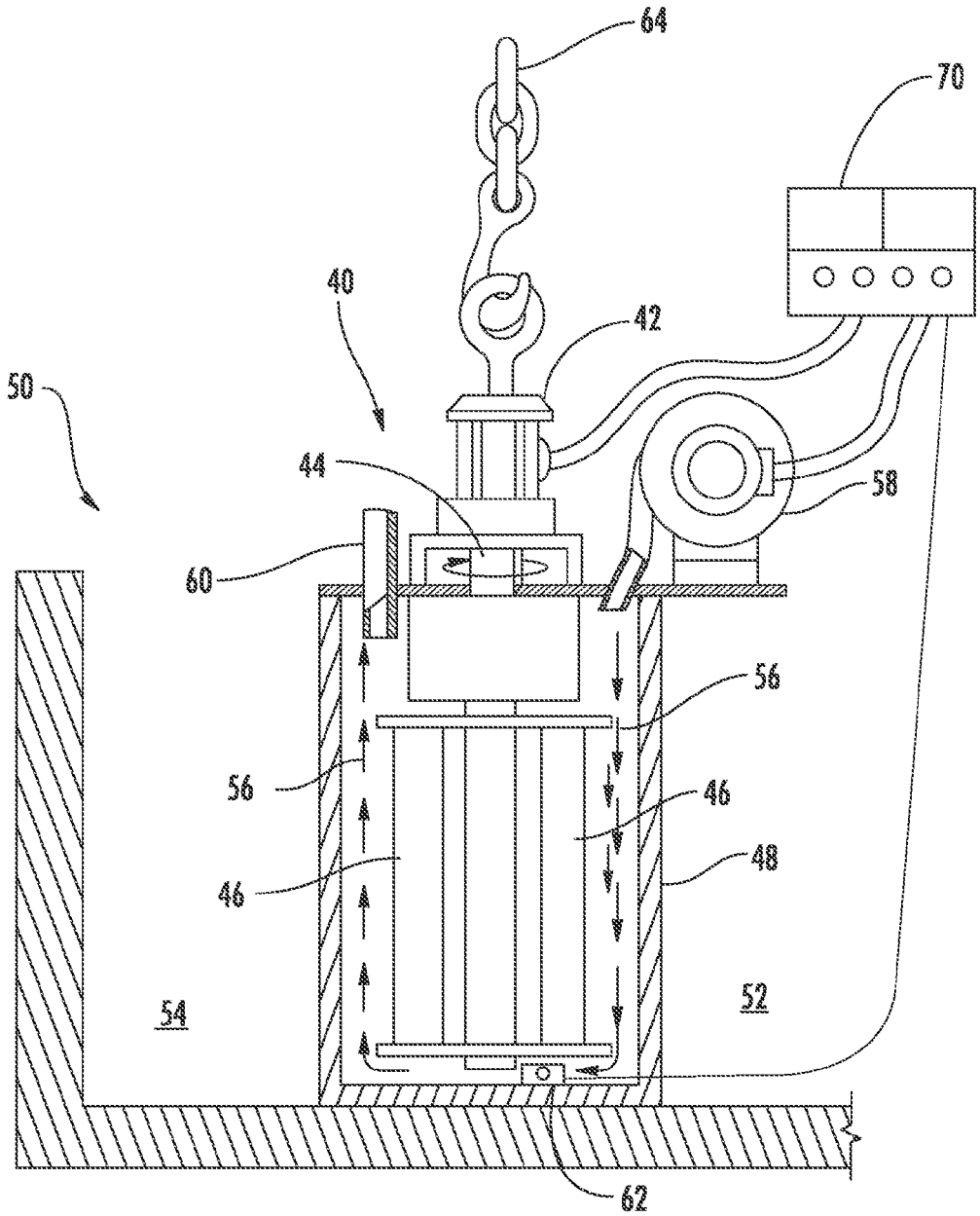
FIG. 4 is a schematicized side view, partially in section, of another embodiment of the pump of this invention in a well in a metal furnace.

FIG. 4 depicts another embodiment of a magnetic pump in a well of this invention. Pump 40 is a permanent magnetic based pump and includes a motor/gearbox 42 that drives a shaft 44 that rotates permanent magnets 46 within a well 48 positioned in a molten metal furnace 50 having a main hearth area 52 and a side well 54. Cooling medium indicated by arrows 56 is blown into the well 48 by a blower 58 and exits through port 60. A controller 70 controls motor/gearbox 42 and blower 58. In the event of a breach of well 48 a signal from detector 62 can activate a lift system to lift the pump out of the well. As shown in FIG. 4, the lift system includes a hoist (not shown) attached to chain 64 or cable attached to motor/gearbox 42 and capable of lifting pump 40 out of the well 48 to protect it from damage.

Figure 7:
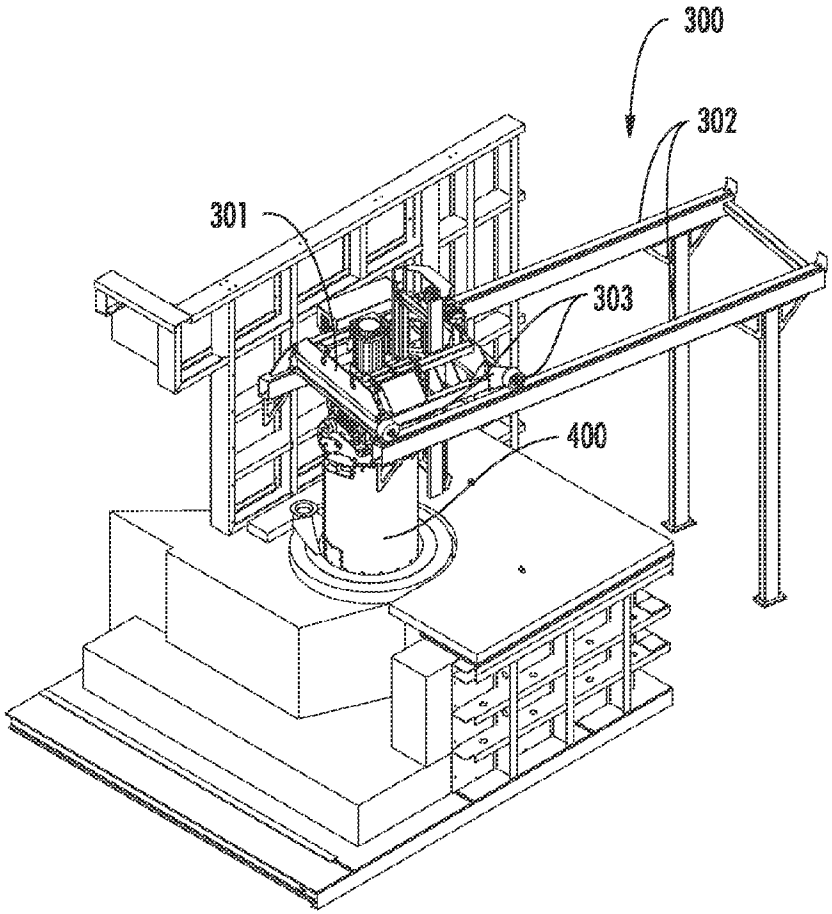
FIGS. 6-7 are isometric views of a lift system according to an embodiment.
Figure 6:
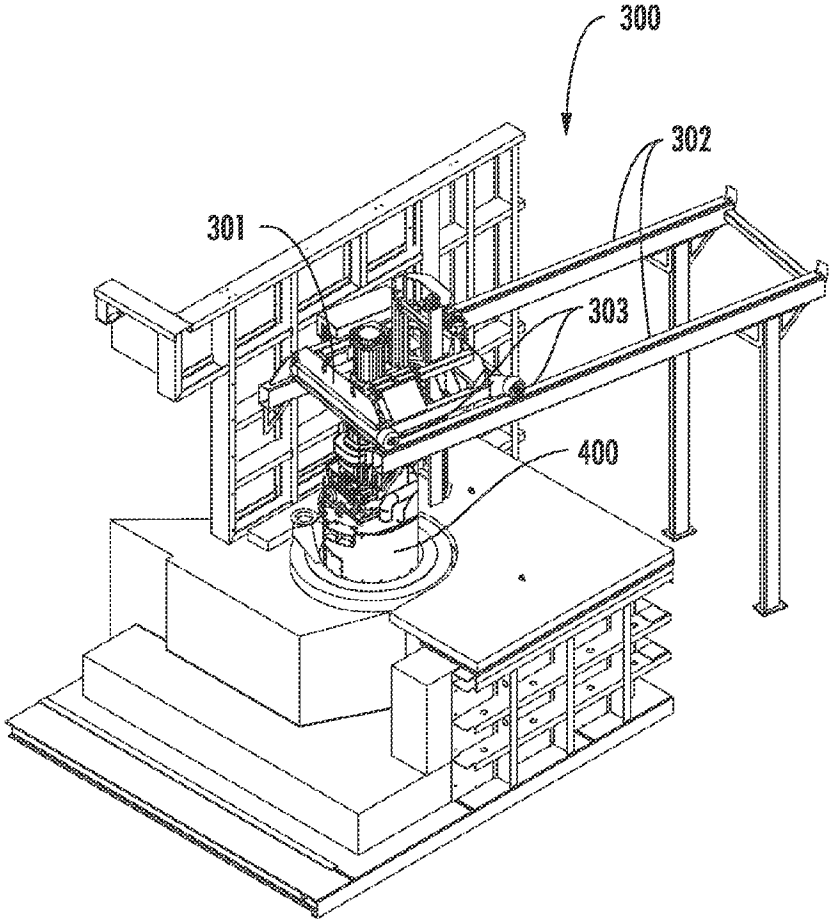

FIGS. 6-7 illustrate another non-limiting embodiment of a lift system 300 configured to hoist a pump (such as pump 400) out the well in the event of a breach. The lift system 300 illustrated in FIGS. 6-7 includes a cart 301 having a plurality of wheels 303. The cart 301 is configured to traverse along a set of rails 302 to move the pump 400 away from the furnace.

Detector 62 can be a thermocouple or other temperature detector for detecting the temperature within the well at the location of the detector. In some cases, detector 62 is a duplex type K thermocouple with an open-ended protection tube and ceramic bead insulators, although any suitable thermocouple or other temperature detector may be used.

Detector 62 could, alternatively, be a detector capable of detecting the presence of molten metal in the well by other means. It can also be any other detector adapted to directly or indirectly detect a condition, such as elevated temperature, cessation of air flow, conductivity which indicates the presence of molten metal, change in moisture content of the air or any other parameter or condition capable of being monitored.

In some embodiments, more than one detector 62 is used and in some cases, more than one type of detector is used. In one non-limiting embodiment, a thermocouple or other temperature detector is used, as well as a detector capable of detecting the presence of molten metal by another means, such as by measuring conductivity with a conduction probe. In one non-limiting embodiment, one of the detectors may be part of a Warrick® conductivity system circuit that has liquid level sensing capabilities such as, but not limited to, Warrick® Series 16M controls.

If used, a thermocouple element may detect temperature from any suitable location, for example but not limited to, approximately ½" from the bottom of the well 48. If used, a conductivity system, such as but not limited to a Warrick relay reference probe, may be connected directly to the well wall to detect a breach by sensing conductivity associated with any metal infiltration.

A programmable logic controller or suitable processer can receive and interpret the signal from detector 62 and initiate any suitable action. For example, the PLC can sound or display an alarm so that a furnace operator can determine whether to lift pump 40 out of the well 48, or take any other appropriate action. Alternatively, the PLC can activate a lift apparatus to lift pump 40 out of well 48. Signals from detector 62 and/or the PLC could also be used to automatically or through operator action otherwise control the furnace by, for instance, stopping rotation of the magnets 46 or adjusting the speed of rotation by adjusting operation of motor/gearbox 42, adjust cooling airflow 56 by adjusting operation of blower 58, or changing heat input to the main hearth 52 or some other portion of the furnace 50.

Figure 5:
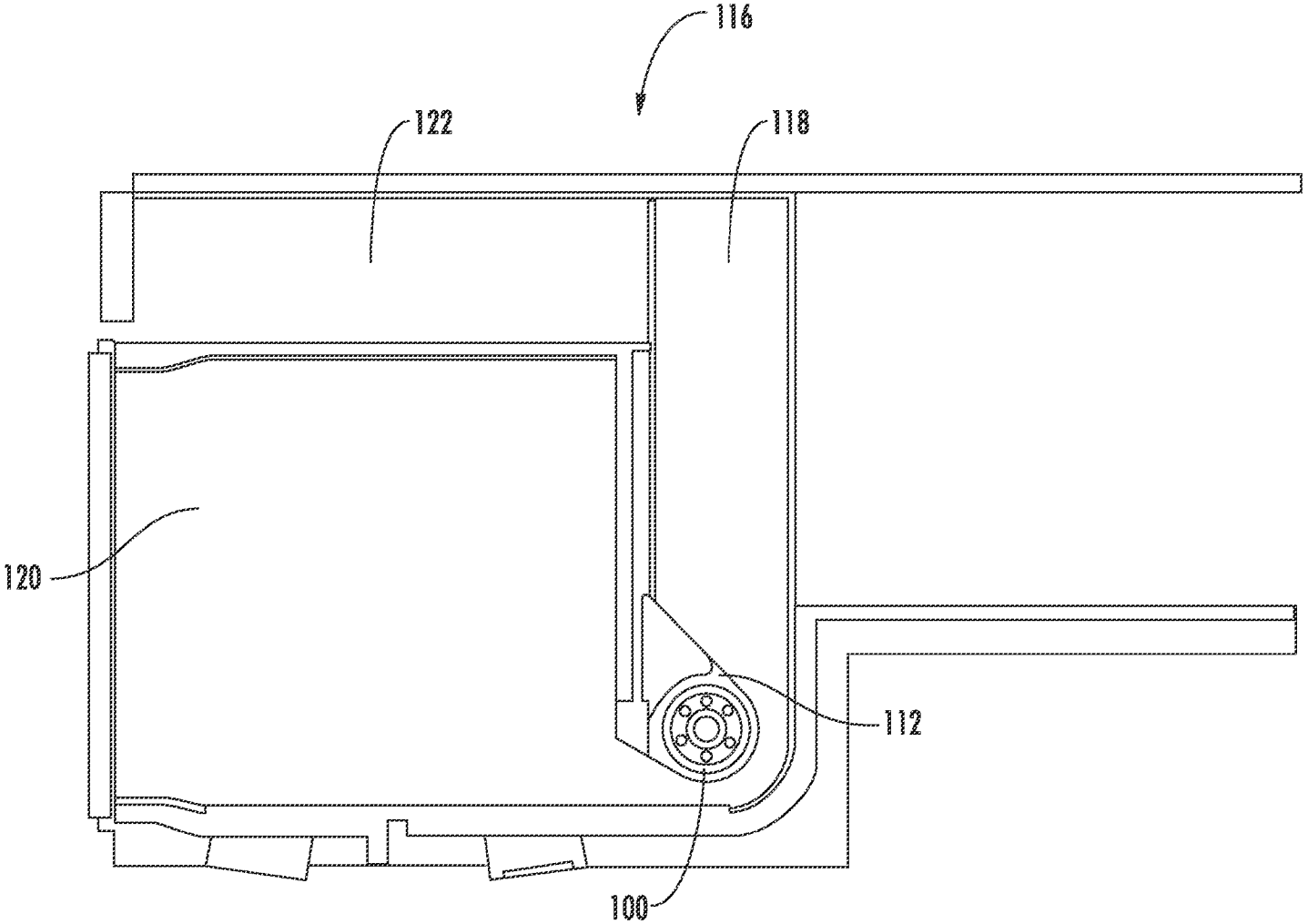
FIG. 5 is a schematic plan view of a furnace and pump according to another embodiment.

FIG. 5 is another plan view depicting an embodiment of a permanent magnet pump in a well. As shown, a magnetic pump 100 is positioned in a well 112 that is located entirely inside a metal melting furnace 116 and near a side well 118 of furnace 116. Certain kinds of scrap (such as, without limitation, light gauge, clips, chips, or post-consumer based bale scrap) may be added in the side well 118 and/or side well 122 and the extra turbulence in the molten metal generated by the pump 100 quickly submerges and melts the scrap. Agitation in side well 112 also agitates the metal in other areas of the furnace and circulates the metal between the main hearth area 120, the side well 118, and the side well 112 of the furnace 116. In some embodiments, submerged ports allow metal to flow between side well 112 and hearth area 120 and between side well 112 and side well 118.

All patents, publications and abstracts cited above are incorporated herein by reference in their entirety.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

The invention claimed is:

1. An apparatus for circulating molten metal in a vessel containing the molten metal, the apparatus comprising:

a well located entirely within the vessel and spaced apart from exterior walls of the vessel; and a rotatable permanent magnet positioned within the well, wherein the well comprises a wall with an arcuate portion that surrounds at least a part of the rotatable permanent magnet and a non-arcuate portion that extends from the arcuate portion of the wall such that the non-arcuate portion forces the molten metal to flow in a path further from the well than the arcuate portion;

a detector for detecting breach of the well; and a lift actuatable in response to a signal from the detector to lift the rotatable permanent magnet out of the well.

2. The apparatus of claim 1, wherein the non-arcuate portion is tangential to the arcuate portion.

3. The apparatus of claim 1, wherein the path is a tortuous path.

4. A molten metal furnace comprising:

a. a main hearth, b. a side well, c. a furnace wall surrounding at least the main hearth and the side well, and d. an apparatus for agitating molten metal within the furnace, the apparatus comprising:

i. a pump well comprising a generally cylindrical refractory wall positioned entirely within the furnace, adjacent to the side well and not contacting the furnace wall and comprising a non-cylindrical wall that extends from the generally cylindrical refractory wall and forces the molten metal to flow in a tortuous path that is further from the wall than the generally cylindrical refractory wall, and ii. an eddy current pump at least partially within the pump well, the pump comprising:

1. a rotatable magnet assembly, and 2. a motor for rotating the magnet assembly;

e. a detector for detecting breach of the pump well; and f. a lift actuatable in response to a signal from the detector to lift the eddy current pump out of the pump well.

5. The furnace of claim 4, wherein the pump well is adjacent to the side well.

6. The furnace of claim 4, further comprising a means for cooling the eddy current pump.

7. The furnace of claim 6, wherein the cooling means is a blower for injecting cooling medium into the well.

8. The furnace of claim 7, further comprising a jacket adapted for passing cooling medium around the eddy current pump.

9. The furnace of claim 4, wherein the non-cylindrical wall is tangential to the generally cylindrical refractory wall.

10. A molten metal agitation apparatus for use in a non-ferrous molten metal furnace, the apparatus comprising:

a. a pump vessel positionable inside a furnace vessel and spaced apart form exterior walls of the furnace vessel, b. a rotatable magnet arrangement positioned within the pump vessel, wherein the pump vessel comprises a wall with an arcuate portion that surrounds at least a part of the rotatable permanent magnet arrangement and a non-arcuate portion that extends from the arcuate portion of the wall and is configured so that the non-arcuate portion forces the molten metal to flow in a path further from the pump vessel than the arcuate portion, and c. a motor for rotating the rotatable magnet arrangement.

11. The agitation apparatus of claim 10 wherein the rotatable magnet arrangement comprises at least one permanent magnet.

12. The agitation apparatus of claim 11, further comprising a detector positioned in the pump vessel for determining at least one parameter in the pump vessel.

13. The agitation apparatus of claim 12, further comprising a hoist for removing the rotatable magnet arrangement at least partially out of the pump vessel.

14. The agitation apparatus of claim 13, wherein the hoist is configured to move the rotatable magnet arrangement out of the pump vessel when the detector determines the at least one parameter.

15. The agitation apparatus of claim 12, wherein the detector is a thermocouple.

16. The agitation apparatus of claim 12, wherein the detector is a conduction detector.

17. The agitation apparatus of claim 10, wherein the path is a tortuous path.

18. The agitation apparatus of claim 10, wherein the non-arcuate portion is tangential to the arcuate portion.

* * * * *